US007373723B1

(12) United States Patent
Tupper, Jr.

(10) Patent No.: US 7,373,723 B1
(45) Date of Patent: May 20, 2008

(54) BOW SIGHT

(76) Inventor: John M. Tupper, Jr., 418 Fisher Rd., Summerville, SC (US) 29483

( * ) Notice: Subject to any disclaimer, the term of this patent is extended or adjusted under 35 U.S.C. 154(b) by 0 days.

(21) Appl. No.: 11/222,318

(22) Filed: Sep. 7, 2005

(51) Int. Cl.
*F41G 1/467* (2006.01)

(52) U.S. Cl. ..... 33/265; 124/87

(58) Field of Classification Search ..... 33/265; 124/87, 90
See application file for complete search history.

(56) References Cited

U.S. PATENT DOCUMENTS 3,969,825 A * 7/1976 Mathes ..... 33/506
4,656,746 A * 4/1987 Gillespie ..... 33/265
5,080,084 A * 1/1992 Kendall et al. ..... 124/87
5,148,603 A * 9/1992 Beutler ..... 33/265
5,860,408 A * 1/1999 Summers ..... 33/265
5,979,427 A * 11/1999 Chalin et al. ..... 33/265
5,996,569 A * 12/1999 Wilson ..... 33/265
6,131,295 A * 10/2000 Cranston ..... 33/265
6,170,164 B1 * 1/2001 Knowles ..... 33/265
6,601,308 B2 * 8/2003 Khoshnood ..... 124/87
6,612,299 B2 * 9/2003 Martin et al. ..... 124/86
6,892,462 B2 * 5/2005 Rager ..... 33/265
6,981,329 B1 * 1/2006 Strathman ..... 33/265
7,040,027 B1 * 5/2006 Shaffer et al. ..... 33/265
2003/0019118 A1 * 1/2003 Wilson ..... 33/265

* cited by examiner

*Primary Examiner*—G. Bradley Bennett

(57) ABSTRACT

A bow sight is disclosed. The bow sight includes a generally transparent bow sight body. At least one fiber optic cable is provided in the bow sight body and generally surrounds a line of sight through the bow sight body.

7 Claims, 4 Drawing Sheets

BOW SIGHT

The present invention relates to bow sights for bows. More particularly, the present invention relates to a rear bow sight which enhances sighting of a sight pin in a front bow sight of a bow, particularly under low-light conditions.

BACKGROUND OF THE INVENTION

Bow hunting has gained increasing popularity in the United States and abroad. Bow hunting is suitable for hunting a variety of wild game including deer, elk and bear, for example. Many bow hunters are challenged by the visual acuity and hand-to-eye coordination which is necessary to properly sight an arrow to a target for a successful kill.

Typically, a bow includes a front bow sight which is mounted on the body or frame of the bow and includes a sight pin. A rear bow sight is mounted typically on the string of the bow and includes a transparent peep which may be provided with cross-hairs. Adequate lighting is necessary for a hunter to aim an arrow at a target, as this requires alignment of the sight pin in the front bow sight with the target and alignment of the cross-hairs in the rear bow sight with the sight pin. Therefore, as dusk approaches, a bow hunter must frequently cease bow hunting due to inadequate lighting.

Accordingly, a bow sight is needed which is capable of gathering and focusing light to enable a bow hunter to aim an arrow at a target under low-light conditions.

SUMMARY OF THE INVENTION

The present invention is generally directed to a bow sight which enhances sighting of a target in a dim environment. The bow sight includes a generally transparent bow sight body. At least one fiber optic cable is provided in the bow sight body and generally surrounds a line of sight through the bow sight body.

BRIEF DESCRIPTION OF THE DRAWINGS

The invention will now be described, by way of example, with reference to the accompanying drawings, in which.

DETAILED DESCRIPTION OF THE INVENTION

Figure 1:
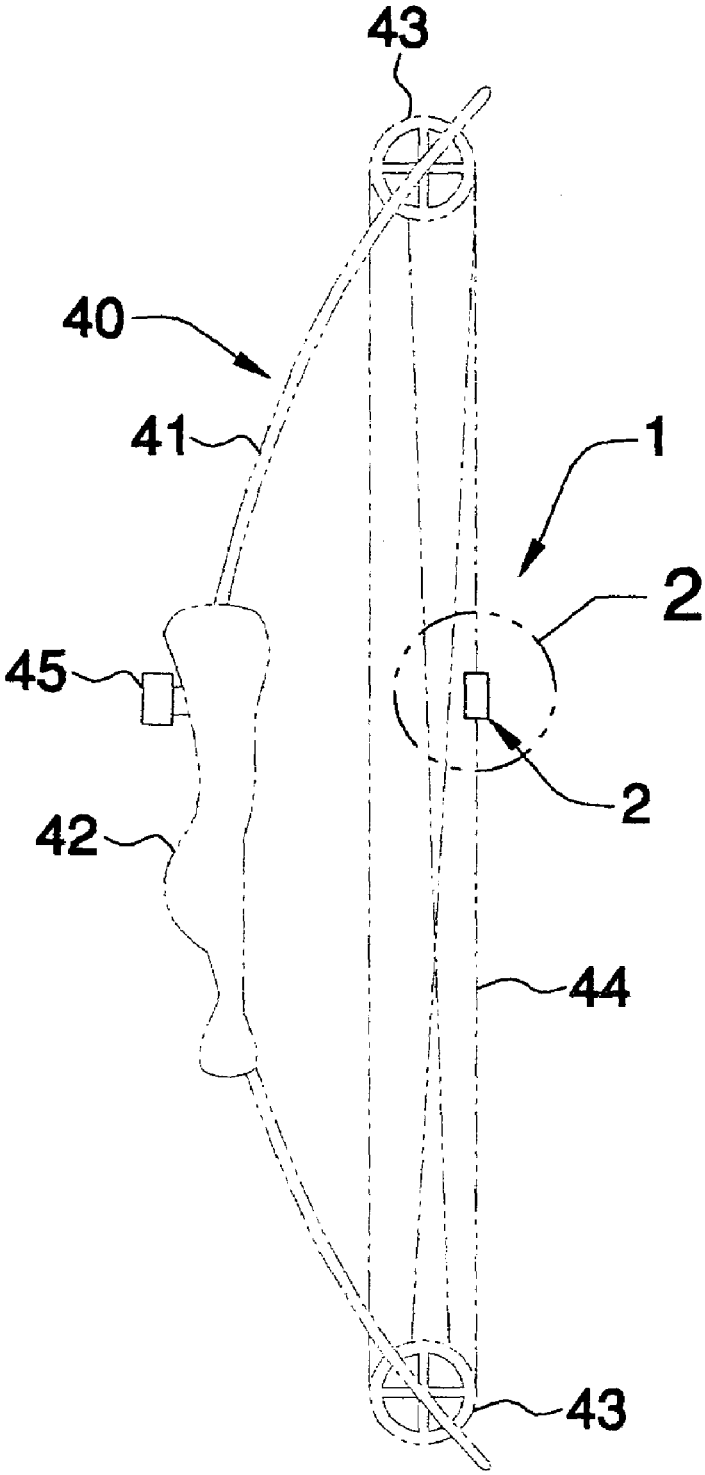
FIG. 1 is a side view of a bow (shown in phantom), with an illustrative embodiment of a bow sight (shown in solid lines) according to the present invention mounted on the string of the bow.

Referring to the drawings, an illustrative embodiment of the bow sight according to the present invention is generally indicated by reference numeral 1. As shown in FIG. 1, the bow sight 1 is typically mounted on a bow 40 which may include an elongated, flexible, arcuate bow body 41 fitted with a hand grip 42. A front bow sight 45, which typically includes a sight pin (not shown), is mounted typically on the bow body 41 or hand grip 42. Rotatable string tensioning wheels 43 are mounted on respective ends of the bow body 41. A bow string 44 is trained on the string tensioning wheels 43. The bow sight 1 is typically mounted as a rear bow sight on the bow string 44 and enhances sighting of the sighting pin (not shown) in the front bow sight 45, particularly under low-light conditions, as will be hereinafter described.

Figure 3:
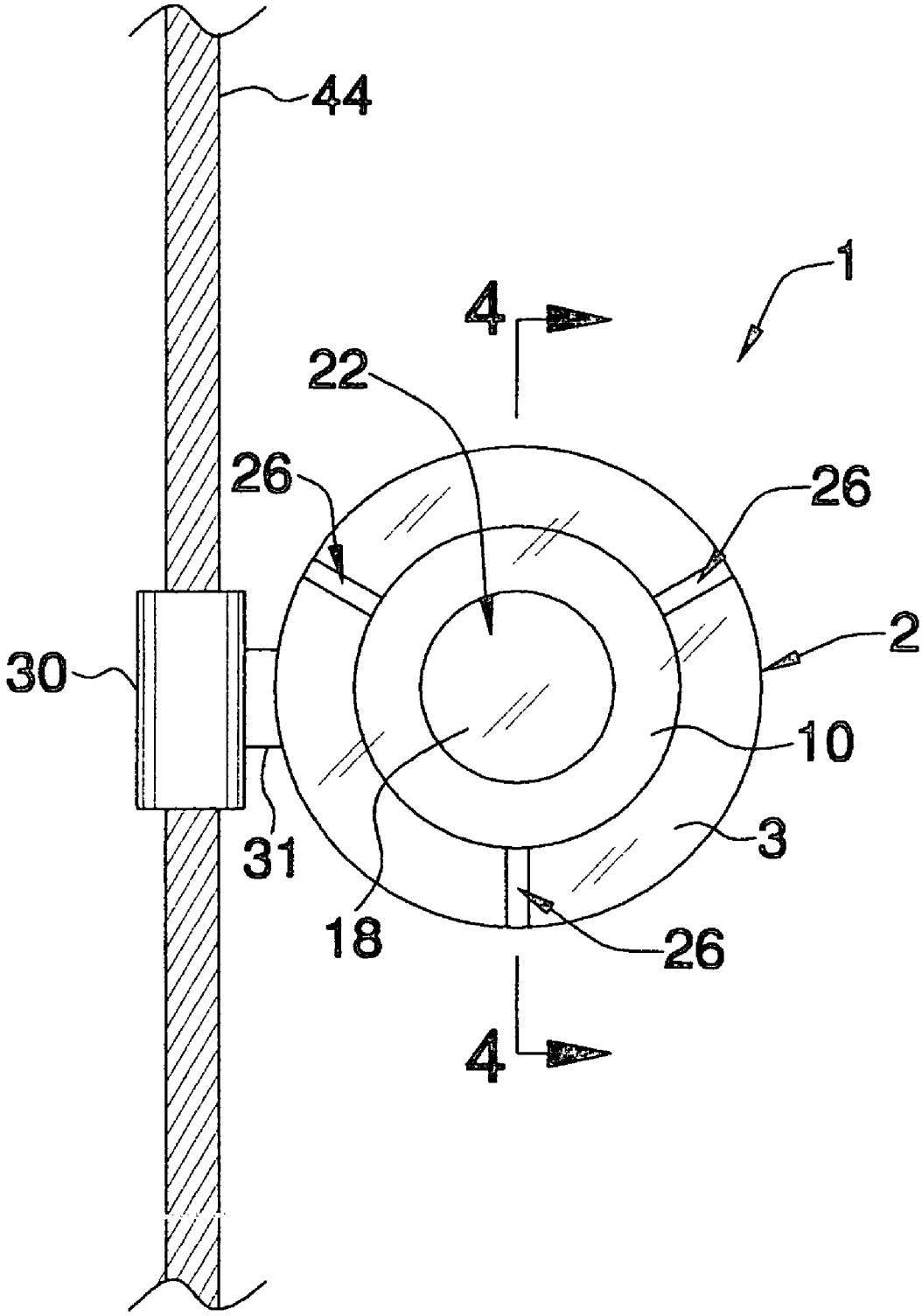
FIG. 3 is a front view of the bow sight, mounted on a bow string of a bow.
Figure 4:
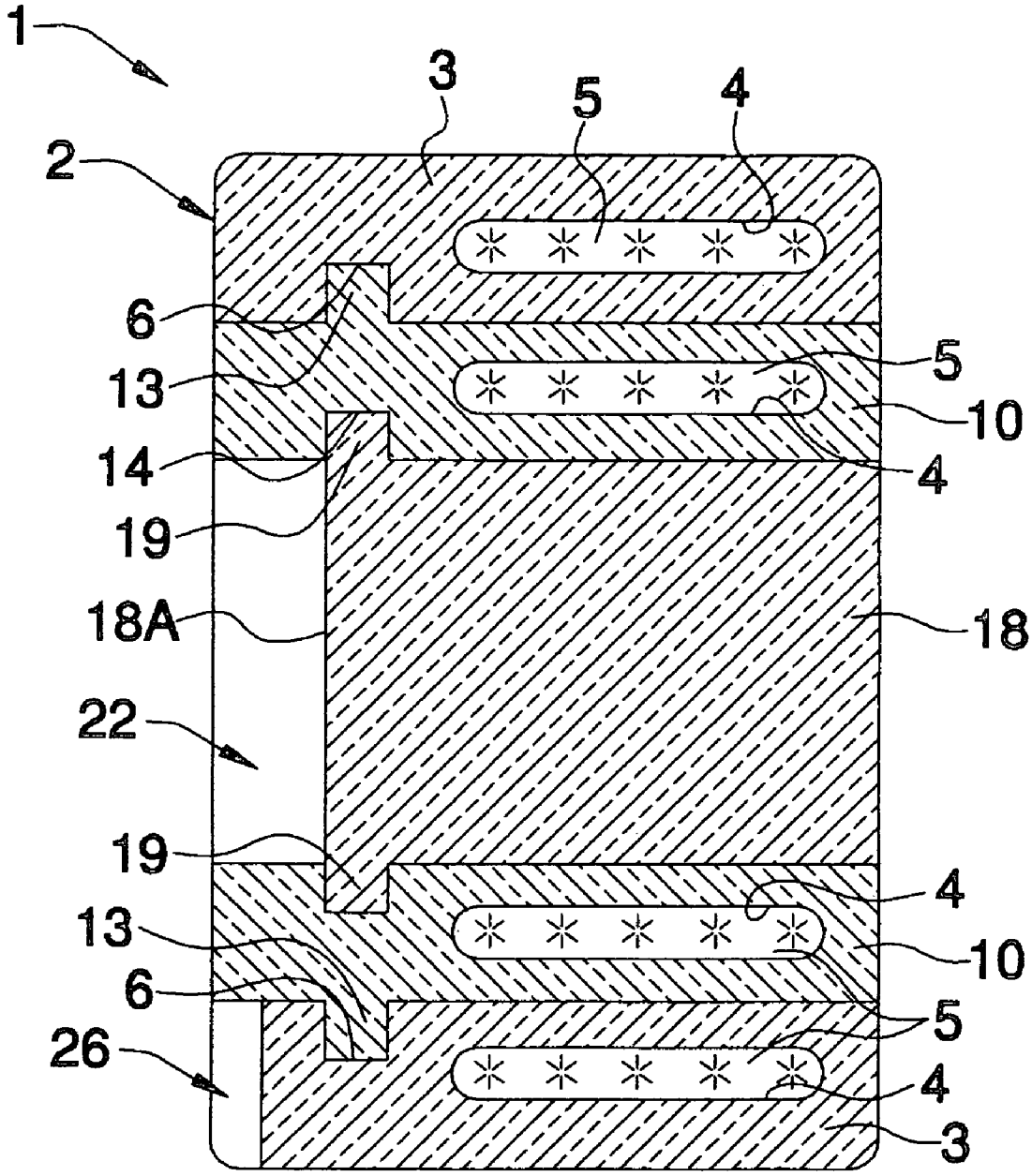
FIG. 4 is a cross-sectional view, taken along section lines 4-4 in FIG. 3, of the bow sight.

As shown in FIGS. 3 and 4, the bow sight 1 includes a bow sight body 2 which may have a generally cylindrical or disc-shaped configuration, as shown. The bow sight body 2 may include an outer ring 3, an inner ring 10 and a central portion 18 which are concentric with each other. The central portion 18 defines a line of sight through the bow sight body 2. As shown in FIG. 4, the outer ring 3 may include an inner tab groove 6 which receives an outer ring tab 13 extending from the inner ring 10, and the inner ring 10 may include an inner tab groove 14 which receives an outer tab 19 extending from the central portion 18. Alternatively, the outer ring 3, inner ring 1 and central portion 18 may be continuous with each other and form a one-piece construction of the bow sight body 2. Preferably, the outer ring 3, inner ring 10 and central portion 18 are clear or transparent plastic.

As shown in FIG. 3, multiple notches 26 may extend into the outer ring 3 of the bow sight body 2. Preferably, the notches 26 are disposed at a generally 120-degree angle with respect to each other. As shown in FIG. 4, the front surface 18*a* of the central portion 18 may be recessed from the front plane of the bow sight body 2, defining a central recess 22.

As shown in FIG. 4, at least one cable cavity 4 extends through the bow sight body 2. Typically, the cable cavity 4 has a generally annular shape and encircles the center of the bow sight body 2. Preferably, a cable cavity 4 extends through at least one of the outer ring 3 and the inner ring 10 of the bow sight body 2. Most preferably, a cable cavity 4 extends through both the outer ring 3 and the inner ring 10 of the bow sight body 2, with the cable cavities 4 disposed in generally concentric relationship to each other.

A fiber optic cable 5 extends through each cable cavity 4. Preferably, the fiber optic cable 5 is a bright color such as red, green or blue, for example. It is preferred that the fiber optic cable 5 has a color which is different than that of the sight pin (not shown) provided in the front sight 45 of the bow 40. The fiber optic cable 5 forms a generally annular configuration, generally matching the contour of the cable cavity 4 through which it extends.

Figure 2:
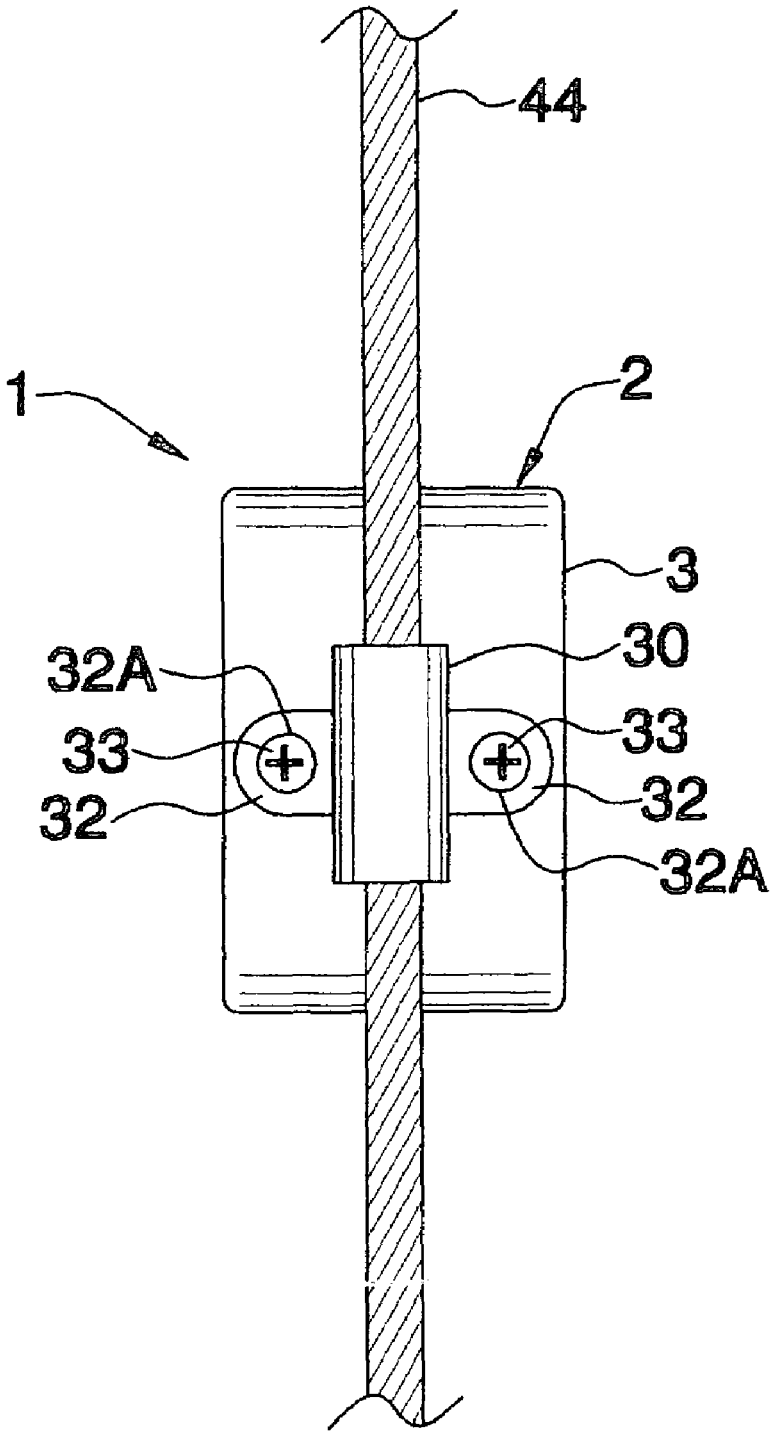
FIG. 2 is an enlarged sectional view, taken along section line 2 in FIG. 1, of the bow string of the bow, more particularly illustrating an exemplary technique for mounting the bow sight on the bow string.

As shown in FIGS. 2 and 3, the bow sight body 2 may be attached to a mount sleeve 30 which is threaded on the bow string 44 of the bow 40. As shown in FIG. 3, a support member 31 may be attached to the mount sleeve 30 and the bow sight body 2 mounted on the support member 31. Preferably, the support member 31 is pivotally attached to either the mount sleeve 30 or the bow sight body 2 such that the bow sight body 2 is pivotal with respect to the mount sleeve 30. As shown in FIG. 2, mount tabs 32 may extend from the support member 31. Screw openings 32*a* extend through the respective mount tabs 32, and mount screws 33 are threaded into the respective mount tabs 32 and into registering screw openings (not shown) provided in the bow sight body 2. A tightening mechanism (not shown), such as a thumb screw, for example, may be provided on the mount sleeve 30 to engage the bow string 44 and tighten the mount sleeve 30 at a selected location along the bow string 44. It will be understood that the mount sleeve 30, support member 31 and mount tabs 32 represent one suitable technique which may be used to mount the bow string body 2 on the bow string 44 and that alternative techniques known to those skilled in the art may be used instead.

Referring again to FIG. 1, in typical use of the bow sight 1, the sight body 2 is located and secured on the bow string 44 behind and in alignment with the front bow sight 45. An arrow (not shown) is fitted in place on the bow 40 and against the bow string 44. A bow hunter (not shown) grasps the hand grip 42 of the bow 40 with one hand. With the other hand, the bow hunter pulls the bow string 44 rearwardly, against the tension imparted on the bow string 44 by the string-tensioning wheels 43. Simultaneously, the bow sight body 2 pivots with respect to the mount sleeve 30 and is maintained in a generally vertical position as the bow string 44 is pulled to the rearmost position. As the bow hunter sights the sighting pin (not shown) in the front sight 45 along a line of sight extending through the central portion 18 of the bow sight body 2, the fiber optic cable or cables 5 collect light and glow or transmit colored light in the form of a light ring to the central portion 18. This improves sighting of the sight pin in the front bow sight 45, particularly in dim light, thereby improving the shooting accuracy of the bow hunter.

While the preferred embodiments of the invention have been described above, it will be recognized and understood that various modifications can be made in the invention and the appended claims are intended to cover all such modifications which may fall within the spirit and scope of the invention.

What is claimed is:

1. A bow sight comprising:

a generally transparent bow sight body having an outer ring, an inner ring concentric with said outer ring and a central portion generally concentric with said inner ring;

at least one cable cavity of annular shape in at least one of said outer ring and said inner ring encircles a center of said bow sight body; and at least one fiber optic cable provided in said at least one cable cavity in said bow sight body and generally surrounding a line of sight through said central portion of said bow sight body.

2. The bow sight of claim 1 wherein said at least one fiber optic cable comprises a first fiber optic cable provided in said outer ring and a second fiber optic cable provided in said inner ring and generally concentric with said first fiber optic cable.

3. The bow sight of claim 1 further comprising a plurality of notches provided in said bow sight body in spaced-apart relationship to each other.

4. The bow sight of claim 3 wherein said notches are disposed at a generally 120-degree angle with respect to each other.

5. The bow sight of claim 1 further comprising a central recess provided in said bow sight body adjacent to said central portion.

6. The bow sight of claim 1 further comprising a mount sleeve and wherein said bow sight body is pivotally carried by said mount sleeve.

7. The bow sight of claim 1, wherein said fiber optic cable is a bright colored cable.

* * * * *